US006305727B1

(12) United States Patent
Bland

(10) Patent No.: US 6,305,727 B1
(45) **Date of Patent: *Oct. 23, 2001**

(54) VEHICLE DOOR LATCH ASSEMBLY

(75) Inventor: Timothy Bland, Evesham (GB)

(73) Assignee: Meritor Light Vehicle Systems (UK) Limited, Birmingham (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/952,800

(22) PCT Filed: May 13, 1996

(86) PCT No.: PCT/GB96/01132

§ 371 Date: Feb. 6, 1998

§ 102(e) Date: Feb. 6, 1998

(87) PCT Pub. No.: WO96/35853

PCT Pub. Date: Nov. 14, 1996

(30) Foreign Application Priority Data

May 13, 1995 (GB) ..... 9509743

(51) Int. Cl.[7] ..... E05C 3/06

(52) U.S. Cl. ..... 292/216; 292/DIG. 23; 70/264

(58) Field of Search ..... 292/216, DIG. 23, 292/DIG. 43, 336.3; 70/264, 262, 263

(56) References Cited

U.S. PATENT DOCUMENTS

| | | | | |
|---|---|---|---|---|
| 3,331,624 | | 7/1967 | Pugh | 292/216 |
| 3,334,935 | * | 8/1967 | Eddy | 292/216 |
| 3,384,404 | | 5/1968 | Slattery | 292/216 |
| 3,388,940 | * | 6/1968 | Dale | 292/216 |
| 3,580,624 | * | 5/1971 | Gmeiner | 292/216 |
| 3,844,595 | | 10/1974 | Meinow | 292/216 |
| 3,998,482 | * | 12/1976 | Nozaki et al. | 292/216 |
| 4,652,027 | * | 3/1987 | Quantz | 292/DIG. 43 |
| 4,691,949 | * | 9/1987 | Grantz et al. | 292/216 |
| 4,823,059 | * | 4/1989 | Compeau et al. | 292/341.16 |
| 4,927,204 | * | 5/1990 | Asada | 292/216 |
| 4,932,277 | * | 6/1990 | Beaux | 292/201 |
| 5,183,300 | * | 2/1993 | Bonne et al. | 292/216 |
| 5,273,324 | * | 12/1993 | Kobayashi | 292/201 |
| 5,288,115 | * | 2/1994 | Inoue et al. | 292/201 |
| 5,618,068 | * | 4/1997 | Mitsui et al. | 292/216 |
| 5,722,706 | * | 3/1998 | Bartel et al. | 292/216 |
| 5,765,884 | * | 6/1998 | Armbruster | 292/216 |
| 5,876,074 | * | 3/1999 | Dowling | 292/216 |

FOREIGN PATENT DOCUMENTS

| | | |
|---|---|---|
| 2153707 | 5/1973 | (DE) . |
| 2442797 | 3/1976 | (DE) . |
| 2037411 | 12/1970 | (FR) . |
| 1 240 619 | 7/1971 | (GB) . |
| 1 300 321 | 12/1972 | (GB) . |
| 1 408 441 | 10/1975 | (GB) . |

* cited by examiner

*Primary Examiner*—Darnell Boucher
(74) *Attorney, Agent, or Firm*—Brinks Hofer Gilson & Lione

(57) ABSTRACT

A passenger vehicle door latch assembly (10) includes a cam e.g. (90*a*) rotating in common with a latching claw (30) which is retained by a pawl (34) at first safety and fully closed positions of an associated door, the shaping of the cam controlling operation of locking mechanism of the assembly. Lobes, e.g. (92*a*,92*b*) on the cam co-act to shift a release lever (64) of the mechanism back to an active position at which it will free the pawl by operation of a door handle for opening of the door even if it has previously been set to a disabled condition at which the door would otherwise be locked so as to prevent inadvertent slam locking of the door Different cams (90*a*, 90*b*, 90*c* or 90*d*) may be substituted in an otherwise common assembly to provide a selection of logic sequences of self-cancelling or prevention of locking operations.

19 Claims, 6 Drawing Sheets

VEHICLE DOOR LATCH ASSEMBLY

Figure 1:
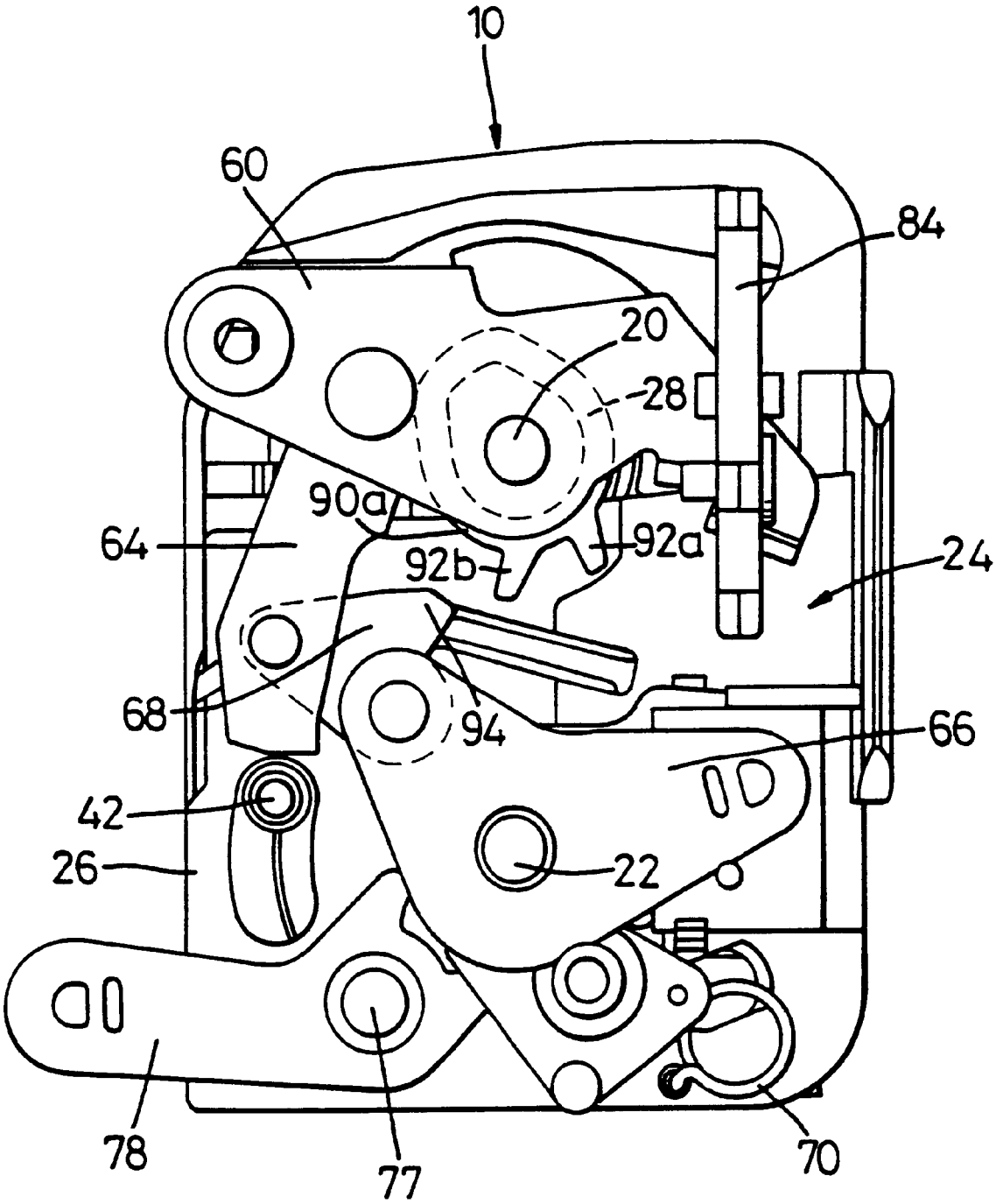

This invention relates to latch assemblies for passenger vehicle doors.

More specifically it relates to rotating claw latch assemblies in which the assembly includes a pivoted claw having a mouth for receiving a coacting striker as the latter enters a recess of the assembly body on closing the associated door. The claw is releasibly retained against rotation which would allow the door to open by a resiliently loaded pawl engaging notches or ratchet teeth of the claw. The claw is so retained at two angular positions or stages, a first safety position at which the door is not fully closed, and a fully latched position at which the door is completely shut against its weather seals. The mechanism so defined is hereinafter referred to as "rotating claw mechanism".

For most applications the assembly will also incorporate a locking mechanism for the security of the vehicle with a view to preventing unauthorised access by in some way blocking or disabling the action of the door handles in releasing the pawl from engagement with the claw for opening the door.

Various forms or modes of operation of the locking mechanism are required to suit differing accepted practices in vehicle markets throughout the world, different customer requirements, and also different kinds of operation of the doors on an individual vehicle. For example there may be three different types of operation of the doors of a four door passenger car, the two rear doors are not usually provided with exterior key operated locks while the drivers and passenger front doors may have such locks but may each operate rather differently. One important consideration is prevention, so far as possible, of the keys being accidentally locked inside the car as would be the case if all four doors had simple slam locking, ie all of them could be set to a locked condition while open which condition would remain undisturbed as the doors were closed.

To avoid the latter problem at least one of the doors is usually provided with a latch assembly incorporating locking mechanism having some kind of self-cancelling action whereby even if it is set to locked condition before closing the door it will be unlocked as the door closes or some kind of blocking action preventing the latch being set to locked condition while the door is open. These arrangements ensure that the key must be used, or some conscious overriding operation effected, from the exterior to secure at least that door.

Various locking logic sequences are built into known locking mechanisms to meet different customer and market demands, for example:

a) Constant self-cancel i.e. the latch cannot be slam locked, closing the door will always result in return to the unlocked condition necessitating use of the key or equivalent to secure the door.

b) Self cancel with keyless override i.e. simply swinging the door shut will self-cancel any locking as above but with provision for overriding that arrangement so that the door can be locked without use of the key or like by a sequence of operations which is unlikely to be carried out inadvertently or by accident. This usually involves locking the latch mechanism prior to closing the door and then effecting closing while holding the exterior door handle up or otherwise out of its position of rest. This logic sequence is generally preferred in the Japanese market.

(c) Interacting i.e. instead of self-cancelling as (a) or (b) above it is impossible to set the locking mechanism into the locked condition while the door is open, that is with the claw not in the first safety or fully latched positions.

(d) Interacting with keyless override i.e. the prevention of locking in the open condition can be overridden by some conscious operation similar to (b) above, typically by holding the exterior handle up or otherwise away from its position of rest which bypasses the blocking of the locking mechanism enabling the latter to be set to the locked condition with the door open. The handle can then be released enabling slam locking with no self-cancelling and without need to use the key or the like. This logic sequence is generally preferred in the European market.

(e) Various "hybrid" logic sequences, e.g. providing differences in operation as between door fully open and door on first safety conditions.

Each of these logic sequences has advantages and disadvantages. Thus with keyless system (b) some users object to having to hold the door handle while pushing the door shut, it may require a two-hand operation and may involve contact with a wet or dirty vehicle exterior.

Some of these sequences, as provided in known vehicles, also have security disadvantages. If the door is inadvertently left closed only to the first safety position a self-cancelling or interacting sequence may either leave the latch mechanism unlocked without the user realising this, or may enable the mechanism to be shifted to the unlocked condition due to the self-cancelling provision as by pushing the door further closed to or towards the fully latched position so that it can then be opened by an intruder.

U.S. Pat. No. 3,384,404 discloses a latch assembly having locking logic sequence of type (b) above i.e. self-cancel with keyless override. It is known from this disclosure to provide said assembly with a pivoted cancellation member operating as a sensing formation adjacent to the claw. A formation on the claw periphery engages said member if the latter and associated locking mechanism has been set to locked condition while the door is open to return it to unlocked condition as the claw rotates to angular positions corresponding to a safety and a fully latched position of the door. The self-cancelling action of the sensing formation can be overridden by holding a manually operable element of the door in a shifted position while closing the door.

The object of the present invention is to provide improvements in latch assemblies having rotating claw mechanism, and more specifically in the locking mechanisms thereof so as to provide economies of manufacture and assembly, and ease of adaptation of a standard assembly to a wide variety of locking logic sequences and forms of manual and/or power operation and control in a particularly simple manner and with minimum inventory of components. Further objects are improvements in vehicle security and in durability and reliable operation of latch assemblies.

According to the invention there is provided a vehicle door latch assembly as distinguished in the claims.

Figure 2:
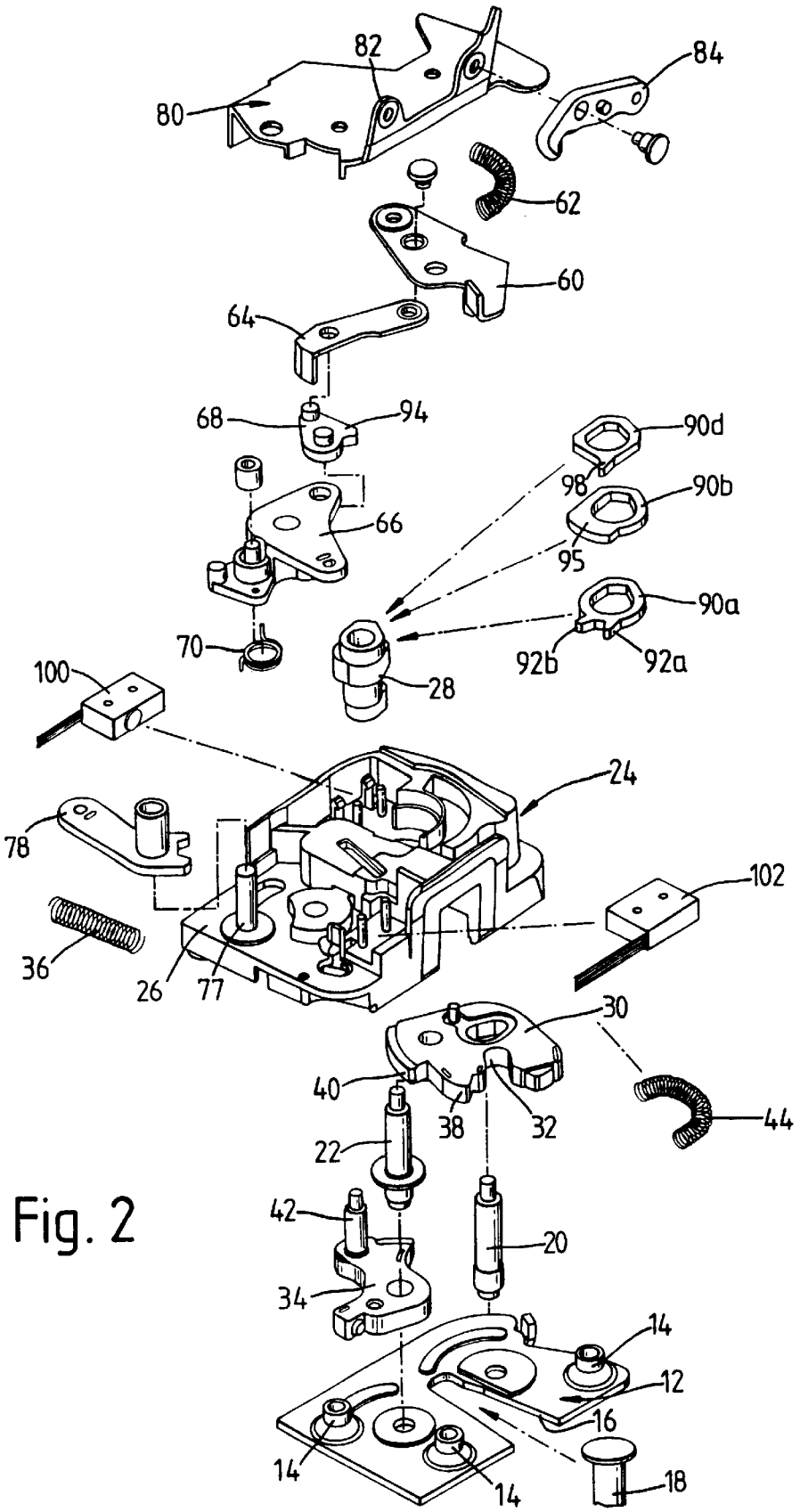
Figure 3:
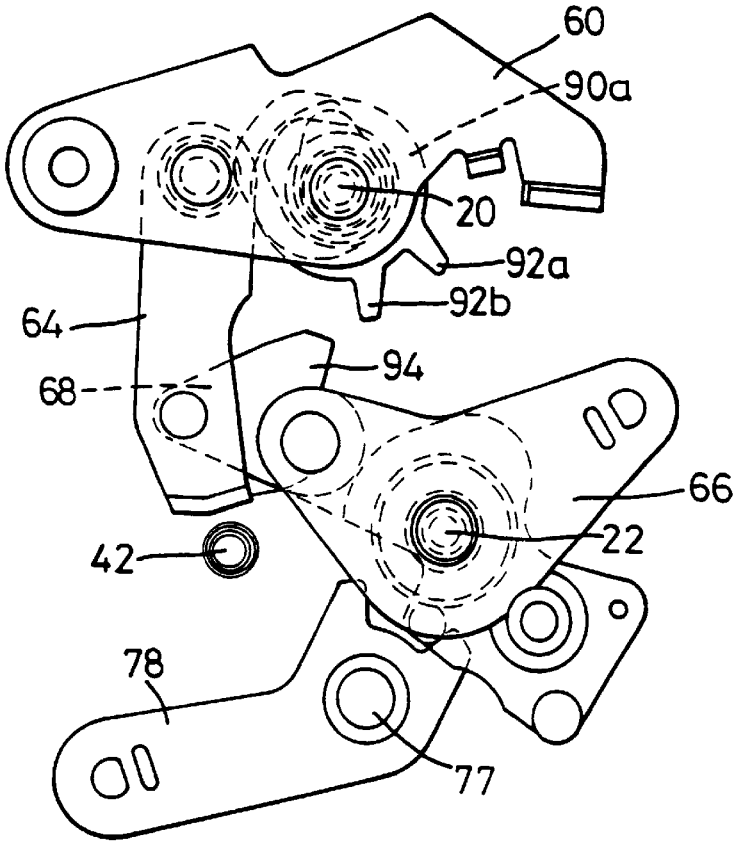

An example of the invention is now more particularly described with reference to the accompanying drawings wherein:

FIG. 1 is elevation of a latch assembly with a back plate removed,

FIG. 2 exploded perspective view of said assembly,

FIGS. 3 to 9 are diagrammatic elevations of parts of latch and locking mechanism of said assembly in various stages or conditions of operation and/or with various forms of cam installed for respective logic sequences.

Referring first to FIGS. 1 and 2, a latch assembly 10 comprises a strong pressed metal retention plate 12 (FIG.2)

forming the outer face of the assembly when mounted on a vehicle door and having countersunk threaded apertures 14 to receive mounting screws. Plate 12 has two spaced parallel posts riveted thereto to extend from its inner face on either side of a slot 16 for entry of a doorpost striker 18. One of these posts is a claw post 20 and the other is a pawl post 22 each of which extends the full depth of the assembly.

A moulded plastics body 24 locates against plate 12 and has a body floor 26 spaced from plate 12. A moulded plastics claw sleeve 28 is journalled on claw post 20 to extend through floor 26, the portion adjacent plate 12 carrying a claw 30 of generally conventional form having a mouth 32 to coact with striker 18. In this example the claw is of composite metal and plastics construction.

Pivoted on pawl post 22, again immediately adjacent to plate 12, is a pawl 34 also of composite construction and resiliently urged by a pawl spring 36 into coacting relationship with first and second ratchet tooth formations 38,40 on an arcuate edge part of claw 30 defining first safety and fully latched positions in known manner.

Pawl 34 carries a pawl stop pin 42 spaced from post 22 which projects through an arcuate slot in body floor 26.

A claw spring 44 located in an arcuate groove of body 24 urges claw 30 anti-clockwise as viewed in the drawings, i.e. towards the door release position so that the door is freed for opening when pawl 34 is shifted out of engagement with the claw.

The actuating and locking mechanism of the assembly is located generally within body 24 on the side of floor 26 remote from plate 12, ie uppermost as viewed in the drawings.

The version of the assembly now described will typically be used at least on the driver's door of the vehicle having inside and outside door handles for unlatching the door when closed, an inside sill button or equivalent manual locking actuator for locking and unlocking the closed door from inside the vehicle, and an exterior key barrel for manual locking and unlocking using appropriate key.

A handle lever 60 is fulcrummed for angular movement on the distal end of claw post 20 overlying claw sleeve 28 and extends transversely of body 24, its left-hand arm as seen in the drawings being operatively linked to the exterior door handle. A return spring 62 acts on the other arm to bias lever 60 clockwise as seen in the drawings.

A release lever 64 is pivoted at one end to an intermediate part of said lefthand arm to extend generally normally of lever 60 towards the pawl stop pin 42. The end of lever 64 adjacent said pin is bent towards floor 26 forming an abutment to engage that pin on movement of lever 60 from its position of rest, so effecting release of claw 30 to unlatch the door if release lever 64 is angularly positioned in alignment with pin 42.

A moulded plastics lock lever 66 is journalled for angular movement on the distal part of pawl post 22. One arm of this lever extends generally towards release lever 64 and it is pivotally coupled thereto by a locking clutch link 68 so that angular movement of lock lever 66 swings release lever 64 into and out of alignment with pawl stop pin 42. When lever 66 is turned clockwise it draws release lever 64 to the right as seen in the drawings putting the mechanism in the locked condition in which release lever 64 is disabled, it will still move in conjunction with handle lever 60 but cannot abut stop pin 42 to unlatch claw 30. Lock lever 66 will be operatively linked to the interior sill button or equivalent. A torsion type index spring 70 acts between lock lever 66 and body 24 to assist in indexing lever 66 to its respective limit positions at each end of its travel.

A moulded post 77 upstanding from floor 26 spaced from pawl post 22 pivots a key lever 78 having an outwardly projecting arm which will be operatively linked to the exterior key barrel. The inward arm portion of that lever is in the form of a fork co-acting with a projecting formation of lock lever 66 for shifting it between locked and unlocked positions by the use of the key.

The last described mechanism is retained in place and substantially enclosed by a pressed metal back plate 80 (Fig.2) secured by riveting the ends of posts 20 and 22. Plate 80 includes a projecting trunnion 82 on which is pivoted an inside handle lever 84, one of arm of which coacts with an abutment at the end of the right hand arm of handle lever 60 for actuation of the latter from the inside door handle in use.

In the form thus far described latch assembly 10 does not incorporate any self-cancelling or other locking logic sequence, the locking mechanism can be set in the locked condition with the door open, closed or at first safety and slam locking is therefore always possible i.e. lock lever 66 can be shifted to the locked position as by use of the sill button with the door open and the door can then be slammed shut (or may swing shut inadvertently) without disturbing that setting and with the possibility, if the other doors are already locked, that the keys may be locked inside the vehicle.

It will be understood that this arrangement may be acceptable for some applications e.g, the lock assemblies for rear passenger doors (which are often not provided with external key barrels so that locking can be effected by use of the sill buttons only, in which case key lever 78 will be omitted from the assembly) or, in combination with external locking by key barrel, for the front passenger door of the vehicle.

It is usually desired that at least one door, typically the driver's door, has some form of self-cancelling or interacting locking logic and this will now be described utilising the standardised latch assembly 10 with the simple addition or interchange of a single component.

That part of claw sleeve 28 which projects beyond body floor 26 is shaped for driving engagement with a press-fit claw angle sensing cam 90 which can take various forms a first of which, 90*a,* is shown in FIGS. 1 to 6 of the drawings.

The operation thereof is best illustrated in FIGS. 3 to 6, said cam having two angularly separated radial projections or lobes 92*a,* 92*b.* The floating locking clutch link 68 includes a shaped projection 94 extending generally in the direction of the claw post 20 with handle lever 60 at its position of rest (FIGS. 1 and 3) and, when link 68 is carried to the right and shifted nearer post 20 (FIGS. 4 and 5) projection 94 is brought closest to the post axis in which position it intersects the path of movement of cam lobes 92*a, b.*

Figure 4:
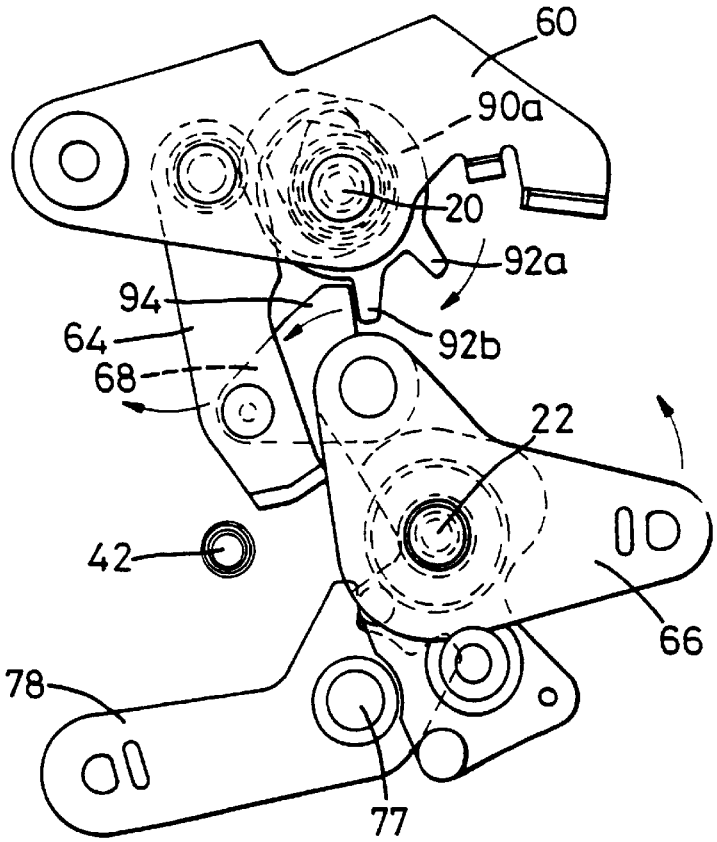
Figure 5:
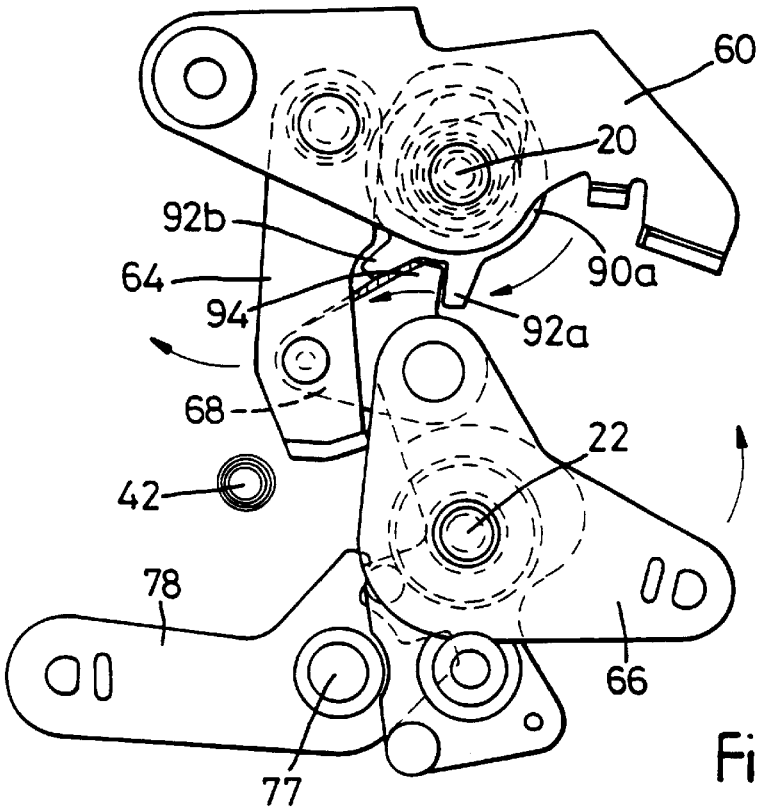

This arrangement provides self-cancelling locking logic with facility for keyless override. If the mechanism is set to locked condition, as by the sill button, with the door open, ie with claw 30 at its unlatched position both lobes 92*a,* 92*b* will be angled to the right of projection 94 which lies in their path (FIG. 4). If the door is now closed to the first safety position the leading lobe 92*b* will kick link 68 to the left and downwards shifting release lever 64 into alignment with pawl stop 42 i.e. the latch is set back to unlocked condition.

If locking is effected at this first safety position projection 94 will enter between lobes 92*a* and 92*b* (FIG. 5) and pushing the door fully shut will again shift the mechanism to unlocked condition by co-action of trailing lobe 92*a* with projection 94.

Figure 6:
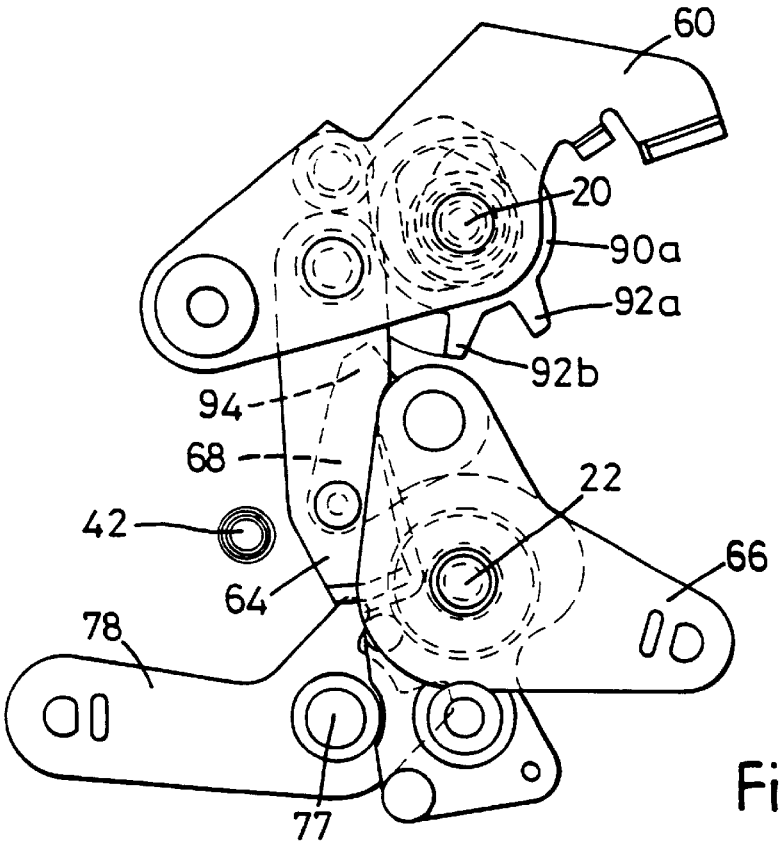

The door can be locked from the outside without use of the key if desired by setting to locked condition using the sill button and holding the outside door handle to keep handle lever 60 rotated anti-clockwise (FIG. 6). This holds clutch link 68 back to underlie release lever 64 even though the latter is at its unlocked position, keeping projection 94 clear of the cam lobes 92 so that there is no self-cancelling interaction with the latter and slam locking can be effected i.e. this logic sequence provides self-cancel with keyless override.

Figure 7:
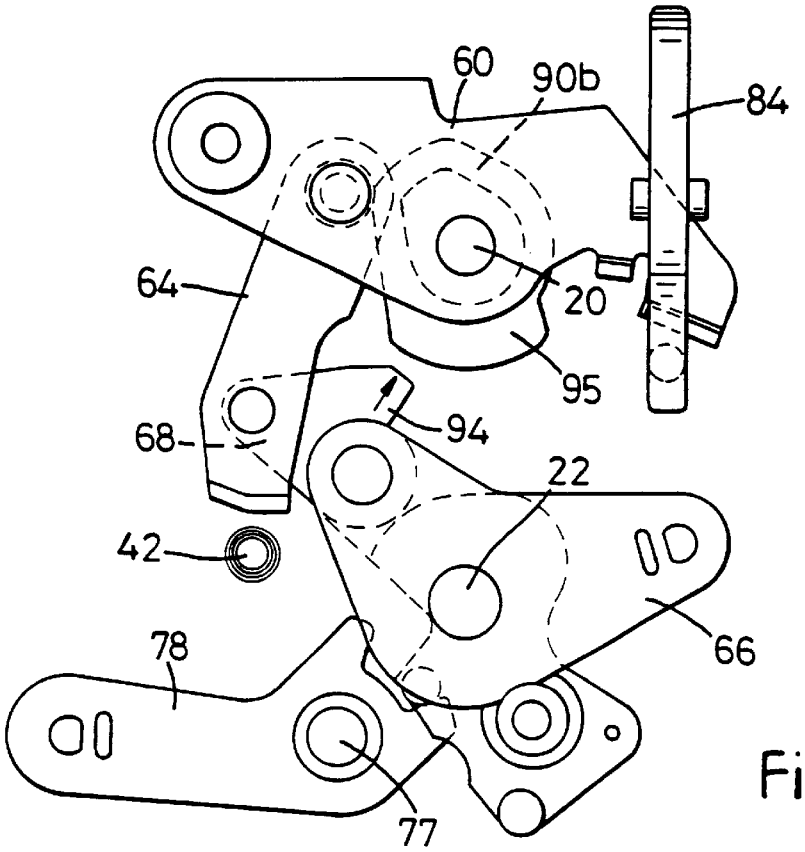

Another form of cam 90*b* is shown as substituted in the FIG. 7 arrangement. This cam has a single continuous lobe 95 with an angular extent of some 80°, extending in the anti-clockwise direction substantially beyond the angular compass of the above two lobes 92*a,* 92*b.* This form of cam prevents the mechanism being set to the locked condition at any angular position of claw 30 other than the fully latched position with the door completely shut, so providing the interacting type of locking logic sequence preferred for the European market; locking cannot be effected at the first safety position.

Again a keyless overriding operation is allowed, putting the handle lever 60 to the position shown in FIG. 6 and setting the locking mechanism to locked condition will bypass or override the interacting or blocking action afforded by cam 90*b.*

Figure 8:
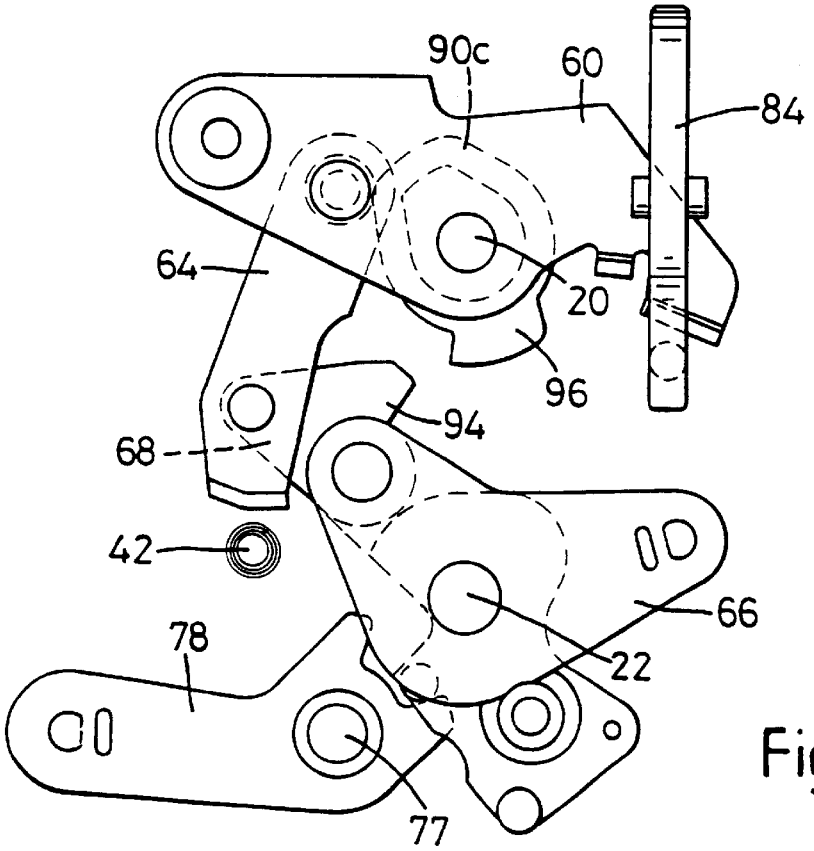

Yet another form of cam 90*c* is shown in FIG. 8 (15) having a single lobe 96 of lesser angular extent than lobe 95, in this example about 50°. This allows the mechanism to be set locked whatever the door handle position when the door is open but self-cancels such locking immediately the claw moves to or beyond the first safety without permitting resetting to locked position at first safety.

Figure 9:
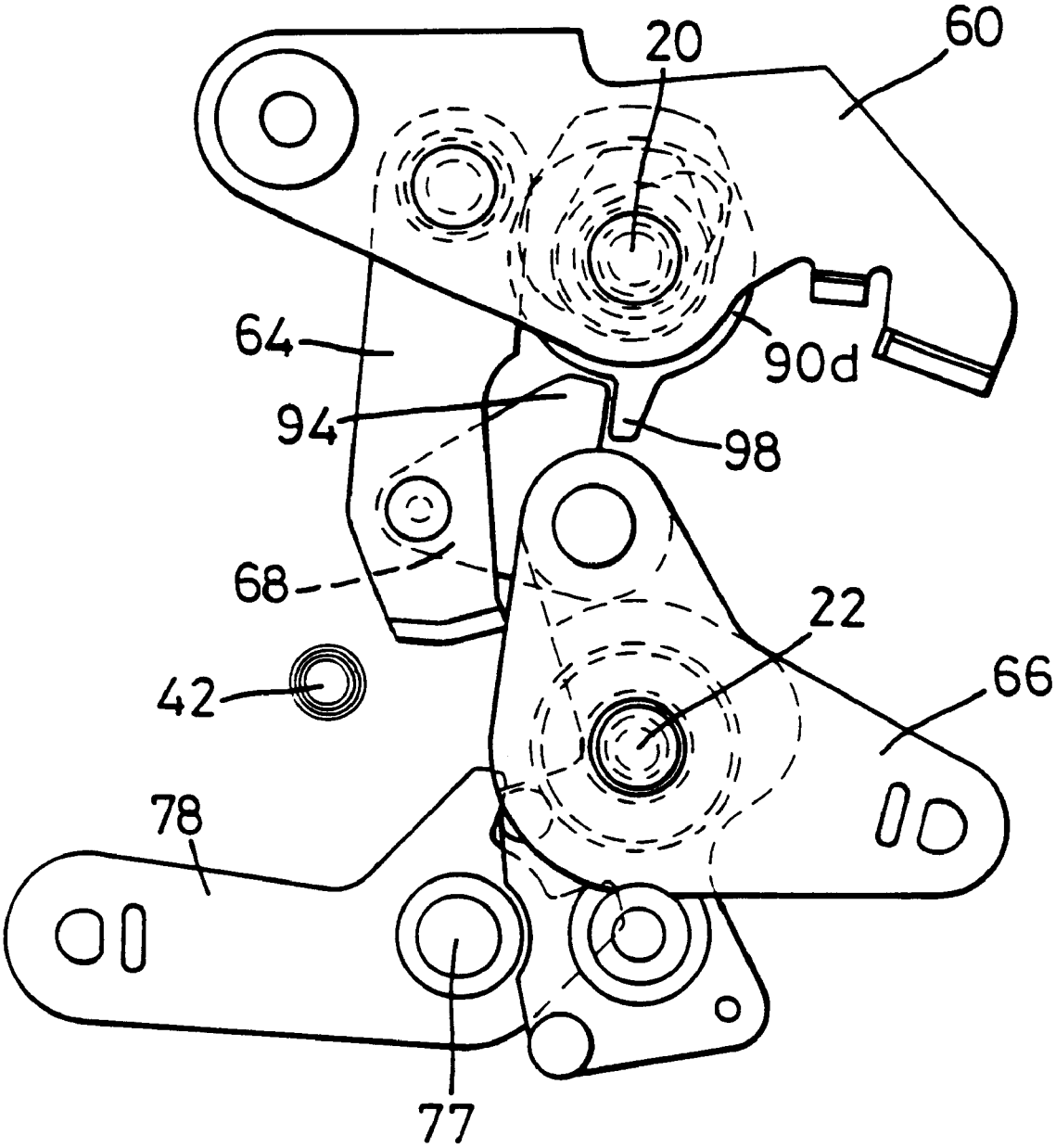

A further form of cam 90*d* is shown in FIG. 9 (16) having only a single narrow lobe 98 equivalent to lobe 92*a* of cam 90*a* but omitting lobe 92*b.* This will self-cancel when the claw shifts from open to first safety positions but, if locking is effected at the latter position, there will be no self-cancel if the door is then pushed fully shut.

The sensing of latch condition directly from the claw by means of the interchangeable cams simplifies the construction and assembly and requires a minimum of components to provide a wide range of types of operation and logic sequences. Previously attempts have been made to provide sensing for logic sequences by reading pawl movement but this is unsatisfactory because the pawl moves twice over the same path in engaging the claw at first safety and fully latched positions so that it is difficult to differentiate between said positions. Special adaptations such as making the two claw ratchet teeth different depths so that the pawl travels over different distances are unsatisfactory because they may affect the security of the door latching, give an unsatisfactory "feel" during operation; and/or add to the complexity of the mechanism and render it less adaptable.

While purely mechanical and manual direct operation has been described above it will be understood that latch assemblies of the invention can readily be provided with electric servo-actuators for operation as part of a central locking system or other remotely controlled system e.g. for locking all doors in unison. Instead of an external key-barrel the relevant door or doors may be provided with electrical sensors for response to coded signals from an infra-red or other non-mechanical key device. The assembly may include sensor switches 100, 102 (FIG. 2) for signaling the condition of the related latch and locking mechanism to a central control unit or other remote station, in the example switch 100 is a "door ajar" switch and switch 102 is a "door locked" switch.

What is claimed is:

1. A latch assembly (10) for a passenger vehicle door including:

a) a pivoted claw (30) having ratchet formations (38,40) and a mouth (32) for operatively receiving a coacting striker (18) as the latter enters a recess of the assembly body (24) on closing the associated door;

b) a resiliently loaded pawl (34) engaging the ratchet formations of the claw to releasably retain the latter against rotation which would allow the door to open at either of two angular positions, a safety position at which the door is not fully closed, and a fully latched position at which the door is fully closed;

c) a locking mechanism for preventing unauthorised access by way of the door in use acting to block or disable the action of an element or elements (60,84) worked by a handle or handles of the door in releasing the pawl from engagement with the claw for opening the door;

d) means for operatively sensing different conditions of the claw and pawl combination respective to the door being open, at the safety position, or fully latched, or between at least any two of those conditions, in response to the operative angular position of the claw; and e) a purely mechanical logic sequence means operating to control the action of the locking mechanism in response to the displacement of said ratchet formations; characterized in that said means for sensing includes a sensing cam formation (90) operatively co-acting with an element (68) of the locking mechanism to control the action of the latter in a logic sequence dictated by the cam profile, action of the element effecting mechanical action of the locking mechanism, said sensing cam formation being operatively mounted co-axially with the claw and coupled for rotation therewith so as to be positively angularly indexed by angular movement of the claw (30) for sensing said conditions.

2. An assembly as in claim 1 characterised in that the locking mechanism includes a release element (64) operatively coupled to the element (60) worked by a movable handle of the door and selectively displaceable by the action of locking means between an active position at which movement of the handle causes the release element to displace the pawl (34) from engagement with the claw (30) to free the door in use and a disabled position at which movement of the handle element is not communicated to the pawl.

3. An assembly as in claim 2 characterised in that the sensing formation (90) controls the action of the locking mechanism by coacting with the release element (64).

4. An assembly as in claim 3 characterised in that the cam formation (90*a*) has two angularly separated radial projections (92*a,b*) each of which acts to return the release element (64) to the active position from previous setting to the disabled position upon rotation of the claw (30) in door closing direction to the first safety position and from the latter position to the fully latched position respectively.

5. An assembly as in claim 3 characterised in that the cam formation (90*b*) has a radial projection (95) of sufficient angular extent to maintain the release element (64) at the active position at any angular position of the claw (30) other than the fully latched position.

6. An assembly as in claim 3 characterised in that the cam formation (90*c*) has a radial projection (96) of sufficient angular extent to maintain the release element (64) at the active position throughout rotation of the claw (30) in door closing direction from and including the first safety position and up to but not including the fully latched position.

7. An assembly as in claim 3 characterised in that the cam formation (90*d*) has a single radial projection (98) acting to return the release element to the active position from previous setting to the disabled position upon rotation of the claw in door closing direction to the first safety position without restricting setting of the release element to the disabled position at or past the first safety position.

8. A latch assembly for a passenger vehicle door comprising:

a) a pivoted claw having ratchet formations and a mouth for operatively receiving a coacting striker as the latter enters a recess of an assembly body on closing of the associated passenger vehicle door;

b) a resiliently loaded pawl engaging the ratchet formations of the claw to releasably retain the latter against rotation which would allow the door to open at either of two angular positions, a safety position at which the door is not fully closed, and a fully latched position at which the door is fully closed;

c) a locking mechanism to block or disable the action of at least one element worked by at last one handle of the door in releasing the pawl from engagement with the claw for preventing unauthorized access by way of the door;

d) a sensor for operatively sensing different conditions of the claw and pawl combination respective to the door being open, at the safety position, or fully latched, or between at least any two of those conditions, in response to the operative angular position of the claw; and e) a purely mechanical logic sequence controller to control the action of the locking mechanism in response to the displacement of said ratchet formations.

9. The assembly of claim 8 wherein said sensor includes a sensing cam formation operatively co-acting with an element of the locking mechanism to control the action of the latter in a logic sequence dictated by the cam profile, action of the element effecting mechanical action of the locking mechanism, said cam formation being operatively mounted co-axially with the claw and coupled for rotation therewith so as to be positively angularly indexed by angular movement of the claw for sensing said conditions.

10. The assembly of claim 8 wherein the locking mechanism includes a release element operatively coupled to an element worked by a movable handle of the door and selectively displaceable by the action of locking means between an active position at which movement of the handle causes the release element to displace the pawl from engagement with the claw to free the door in use and a disable position at which movement of the handle element is not communicated to the pawl.

11. The assembly of claim 8 wherein the sensor controls the action of the locking mechanism by coacting with the release element.

12. The assembly of claim 8 wherein the cam formation has two angularly separated radial projections, each projection acts to return the release element to the active position from a previous setting to the disabled position upon rotation of the claw in door closing direction to the first safety position and from the latter position to the fully latched position respectively.

13. The assembly of claim 8 wherein the cam formation has a radial projection of sufficient angular extent to maintain the release element at the active position at any angular position of the claw other than the fully latched position.

14. The assembly of claim 8 wherein the cam formation has a radial projection of sufficient angular extent to maintain the release element at the active position throughout rotation of the claw in door closing direction from and including the first safety position and up to but not including the fully latched position.

15. The assembly of claim 8 wherein the cam formation has a single radial projection acting to return the release element to the active position from previous setting to the disabled position upon rotation of the claw in door closing direction to the first safety position without restricting setting of the release element to the disabled position at or past the first safety position.

16. A latch assembly (10) for a passenger vehicle door including:

a pivoted claw (30) having a mouth (32) for operatively receiving a coacting striker (18) as the latter enters a recess of the assembly body (24) on closing the associated door, a resiliently loaded pawl (34) engaging notches or ratchet teeth (38,40) of the claw to releasably retain the latter against rotation which would allow the door to open at either of two angular positions, a safety position at which the door is not fully closed, and a fully latched position at which the door is fully closed; and a locking mechanism for preventing unauthorized access by way of the door in use acting to block or disable the action of an element or elements (60,84) worked by a handle or handles of the door in releasing the pawl from engagement with the claw for opening the door:

characterized in that the assembly further includes means for operatively sensing or distinguishing between different conditions of the claw and pawl combination respective to the door being open, at first safety, or fully latched, or between at least any two of those conditions, said means including a sensing formation (90) displaced by rotation of the claw so that said sensing or distinguishing is effected in response to the operative angular position of the claw; and a purely mechanical logic sequence means operating to control the action of the locking mechanism in response to the displacement of said formation, in which formation (90*d*) acts to return the release element to the active position from previous setting to the disabled position upon rotation of the claw in door closing direction to the first safety position without restricting setting of the release element to the disabled position at or past the first safety position.

17. The latch assembly of claim 1 wherein the means for operatively sensing different conditions of the claw and pawl combination is mechanical.

18. The latch assembly of claim 8 wherein the sensor for operatively sensing different conditions of the claw and pawl combination is mechanical.

19. The latch assembly of claim 16 wherein the means for operatively sensing or distinguishing between different conditions of the claw and pawl is mechanical.

* * * * *